US008809684B2

(12) United States Patent
Yamazaki et al.

(10) Patent No.: US 8,809,684 B2
(45) Date of Patent: Aug. 19, 2014

(54) INSULATED WIRE

(75) Inventors: Takanori Yamazaki, Hitachi (JP); Kiyoshi Watanabe, Hitachi (JP); Junichi Abe, Hitachi (JP); Hideyuki Kikuchi, Hitachi (JP); Daisuke Hino, Hitachi (JP)

(73) Assignee: Hitachi Metals, Ltd., Tokyo (JP)

( * ) Notice: Subject to any disclaimer, the term of this patent is extended or adjusted under 35 U.S.C. 154(b) by 101 days.

(21) Appl. No.: 13/075,286

(22) Filed: Mar. 30, 2011

(65) Prior Publication Data

US 2011/0240332 A1 Oct. 6, 2011

(30) Foreign Application Priority Data

Mar. 30, 2010 (JP) ..... 2010-076811

(51) Int. Cl.
*H01B 7/00* (2006.01)

(52) U.S. Cl.
USPC ..... 174/110 SR

(58) Field of Classification Search
USPC ..... 174/110 S, 110 SR
See application file for complete search history.

(56) References Cited

U.S. PATENT DOCUMENTS

| | | | | |
|---|---|---|---|---|
| 4,121,001 | A * | 10/1978 | Gotcher et al. | 428/35.7 |
| 4,804,729 | A * | 2/1989 | Orikasa et al. | 526/336 |
| 5,397,822 | A * | 3/1995 | Lee, Jr. | 524/127 |
| 6,231,979 | B1 * | 5/2001 | Nagamine et al. | 428/379 |
| 7,612,131 | B2 * | 11/2009 | Yamada | 524/126 |
| 8,007,915 | B2 * | 8/2011 | Kurachi | 428/474.4 |
| 2004/0105991 | A1 | 6/2004 | Ishii et al. | |
| 2006/0135661 | A1 * | 6/2006 | Mhetar et al. | 524/127 |
| 2006/0194051 | A1 | 8/2006 | Fukuda et al. | |
| 2007/0265375 | A1 * | 11/2007 | Ishio et al. | 524/114 |
| 2007/0299219 | A1 * | 12/2007 | Higashioji et al. | 525/535 |
| 2010/0101823 | A1 * | 4/2010 | Eaton | 174/110 SR |
| 2011/0224384 | A1 | 9/2011 | Higashioji et al. | |

FOREIGN PATENT DOCUMENTS

| | | | |
|---|---|---|---|
| CN | 1892927 | A | 1/2007 |
| CN | 101056920 | A | 10/2007 |
| JP | 60-185306 | | 9/1985 |
| JP | 2002-056720 | | 2/2002 |
| JP | 2005-203334 | | 7/2005 |
| JP | 2008-101069 | | 5/2008 |
| JP | 2008-163222 | | 7/2008 |
| JP | 4177295 | | 8/2008 |
| WO | WO 2005/106898 | A1 | 11/2005 |

OTHER PUBLICATIONS

Communication mailed Sep. 24, 2013, in connection with Japanese Patent Application No. 2010-076811, 2 pages; Japanese Patent Office, Japan.

Communication issued Apr. 30, 2014, in connection with Chinese Patent Application No. 201110081769.7, 6 pages; State Intellectual Property Office Of The People's Republic of China, People's Republic of China.

* cited by examiner

*Primary Examiner* — Chau N Nguyen
(74) *Attorney, Agent, or Firm* — Antonelli, Terry, Stout & Kraus, LLP.

(57) ABSTRACT

There is provided an insulated wire including a wire conductor and an insulation coating formed on the wire conductor by extrusion coating a resin composition. The resin composition is a mixture of a polyphenylene sulfide-based resin (A) and a polyamide-based resin (B), in which a ratio of parts by mass of the resin (B) to that of the resin (A), i.e. (B)/(A), is not less than 5/95 and not more than 30/70.

10 Claims, 1 Drawing Sheet

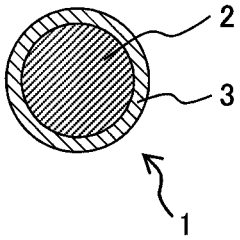
2
3
1

INSULATED WIRE

CLAIM OF PRIORITY

The present application claims priority from Japanese patent application serial no. 2010-076811 filed on Mar. 30, 2010, the content of which is hereby incorporated by reference into this application.

BACKGROUND OF THE INVENTION

1. Field of the Invention

The present invention relates to insulated wires used for coils in electrical equipment such as rotary electric machines and transformers. More particularly, the invention relates to insulated wires covered with at least an extrusion coated insulation layer.

2. Description of Related Art

Insulated or enameled wires are used for coils in electrical equipment such as rotary electric machines and transformers. Such insulated wires are typically formed by applying one or more insulation coatings around a metal conductor having a desired cross section (such as circular and rectangular) depending on the shape and application of the coil. Typically, insulation coatings are formed by the following two methods: One method is to apply, on a wire conductor, an insulation varnish prepared by dissolving a resin in an organic solvent and baking the applied varnish. The other method is to extrusion coat a preblended resin composition on a wire conductor.

Because of the recent demand for compact electrical equipment, insulated wires are wound around a smaller diameter core with a finer pitch under a higher tension in current coil winding processes. Insulation coatings for such insulated wires require sufficient mechanical properties (such as adhesiveness and wear resistance) to withstand severe mechanical stresses caused by such harsh coil winding processes.

Also, because of the recent demand for high efficiency and high output power electrical equipment, there has been an increasing use of inverters and high voltages. As a result, coils are subjected to higher operating temperatures. Hence, insulation coatings also require high thermal resistance. In addition, high voltages (such as surge voltages from an inverter) applied to a coil may generate partial discharges, thus potentially degrading or damaging the insulation coating.

In order to prevent degradation or damage of insulation coatings by partial discharge, insulation coatings having a higher partial discharge inception voltage are being actively developed. One exemplary method for increasing the partial discharge inception voltage of an insulation coating is to use a low dielectric constant resin for the insulation coating. Another exemplary method is to thicken the insulation coating.

For example, JP-A 2002-56720 discloses an insulation coating material containing a fluorine-containing polyimide resin having a special structure. The relative dielectric constant of the insulation coating material of this disclosure is 2.3 to 2.8, which is significantly lower than those of conventional insulation varnishes (about 3 to 4). According to this disclosure, heat generation in the insulation coating can be suppressed because of the low dielectric constant of the coating material.

JP-B 4177295 discloses an insulated wire which is resistant to voltage surges from an inverter. This insulated wire includes: at least one enamel layer that is applied on a wire conductor (or an underlying enamel layer) and baked; and at least one extrusion coated resin layer on the at least one enamel layer. The total thickness of the insulation coating is 60 μm or more, and the total thickness of the at least one enamel layer is 50 μm or less. Each extrusion coated resin layer is made of a resin that, except for polyether ether ketone, has a tensile modulus of elasticity of 1000 MPa or higher at 25° C., and 10 MPa or higher at 250° C. According to this disclosure, the insulated wire has a high partial discharge inception voltage (about 900 V) while maintaining a strong adhesion between the wire conductor and the insulation coating.

WO2005/106898 discloses an insulated wire formed by extrusion coating, on a wire conductor, with two or more insulation layers. At least one of the insulation layers other than the innermost layer is made of a resin mixture including 100 parts by mass of a polyphenylene sulfide resin as a continuous phase and 3 to 40 parts by mass of an olefin-based copolymer as a dispersed phase. According to this disclosure, the insulated wire has excellent thermal and chemical resistance.

The above-cited technologies have the following problems or disadvantages: The above JP-A 2002-56720 technology can reduce the dielectric constant of an insulation coating by making the coating using the disclosed fluorine-containing polyimide resin. However, generally, insulation coatings made of a fluorine-containing polyimide resin have poor adhesion to wire conductors. Thus, an insulation coating made of the fluorine-containing polyimide resin of the JP-A 2002-56720 may be lifted off from a wire conductor by severe mechanical stresses caused by harsh processes such as winding, thereby potentially causing dielectric breakdown of the coating in the worst case scenario.

The above JP-B 4177295 technology increases the partial discharge inception voltage of the insulated wire by increasing the thickness of the extrusion coated resin layer. Furthermore, in order to increase the adhesion between the wire conductor and the extrusion coated resin layer, a baked enamel layer is interposed therebetween, and in a preferred embodiment, an adhesive layer is further interposed between the enamel layer and the extrusion coated resin layer.

However, the properties and method of formation of the enamel layer are significantly different from those of the extrusion coated resin layer, thus adding to the complexity of the manufacturing process of the insulated wire and as a result leading to an increase in the manufacturing cost. When the adhesive layer is used, the manufacturing cost further increases.

SUMMARY OF THE INVENTION

In view of the above problems, it is an objective of the present invention to provide an insulated wire having a higher partial discharge inception voltage than conventional insulated wires without sacrificing the adhesion between the wire conductor and the insulation coating (i.e., while maintaining the adhesion to levels comparable to those of conventional insulation coatings).

According to one aspect of the present invention, there is provided an insulated wire including:

a wire conductor; and an insulation coating formed on the wire conductor by extrusion coating a resin composition, the resin composition being a mixture of a polyphenylene sulfide-based resin (A) and a polyamide-based resin (B), a ratio of parts by mass of the resin (B) to that of the resin (A) being not less than 5/95 and not more than 30/70.

In the above aspect of the present invention, the following modifications and changes can be made.

(i) The insulation coating is heat treated at 250° C. or higher after the extrusion coating.

(ii) The resin (B) includes one or more polyamide-based resins having a melting point of 280° C. or higher.

(iii) The resin (B) includes at least one resin selecting from the group consisting of nylon 46, nylon 6T, nylon 6I, nylon 9T, and nylon M5T.

Advantages of the Invention

According to the present invention, it is possible to provide an insulated wire which has a higher partial discharge inception voltage than conventional insulated wires without sacrificing the adhesion between the wire conductor and the insulation coating (i.e., while maintaining the adhesion to levels comparable to those of conventional insulation coatings).

BRIEF DESCRIPTION OF THE DRAWINGS

FIG. 1 is a schematic illustration showing a cross sectional view of an insulated wire according to an embodiment of the present invention.

DETAILED DESCRIPTION OF THE PREFERRED EMBODIMENTS

The present inventors have intensively investigated the composition and structure of various insulation coatings in order to improve the partial discharge resistance of insulated wires, and obtained the following result. Extrusion coating, on a conductor wire, a resin composition prepared by mixing a polyphenylene sulfide-based resin (A) and a polyamide-based resin (B) in a ratio of parts by mass within a specified range, is effective in achieving the above objective. The invention was developed based on this new finding.

Preferred embodiments of the invention will be described below. The invention is not limited to the specific embodiments described below, but various modifications and combinations are possible without departing from the spirit and scope of the invention.

FIG. 1 is a schematic illustration showing a cross sectional view of an insulated wire according to an embodiment of the present invention. As illustrated, an insulated wire 1 according to an embodiment of the invention is formed by covering a wire conductor 2 with an insulation coating 3. The insulation coating 3 is formed by extrusion coating a resin composition on the conductor 2. The resin composition is prepared by mixing a polyphenylene sulfide-based resin (A) and a polyamide-based resin (B) in a parts by mass ratio (B)/(A) from 5/95 to 30/70. The insulated wire 1 formed in this manner exhibits a higher partial discharge inception voltage than conventional insulated wires without degrading the adhesion between the conductor 2 and the coating 3. When the ratio (B)/(A) is from 5/95 to 10/90, the partial discharge inception voltage of the insulated wire 1 can be particularly effectively enhanced without sacrificing the adhesion of the coating 3.

The polyphenylene sulfide-based resin (A) has high heat resistance and high mechanical properties. However, the use of a polyphenylene sulfide-based resin (A) alone may not always provide sufficient adhesion between the wire conductor 2 and the insulation coating 3. To address this problem, various amounts of the polyamide-based resin (B) were added to the polyphenylene sulfide-based resin (A), and the effects were examined. When the ratio (B)/(A) is less than 5/95, the content of the resin (B) is too low, resulting in an insufficient adhesion improving effect. On the other hand, when the ratio (B)/(A) is more than 30/70, the content of the resin (B) is too high and therefore the polar groups in the polyamide molecules in the resin (B) have a relatively large influence, thereby undesirably lowering the partial discharge inception voltage of the resulting insulated wire 1.

The resin (B) is preferably made of one or more polyamides having a melting point of 280° C. or higher. Examples of polyamides having a melting point of 280° C. or higher are: an aliphatic polyamide such as nylon 46; and aromatic polyamides such as nylon 6T (a co-condensation polymer of hexamethylenediamine and terephthalic acid), nylon 6I (a co-condensation polymer of hexamethylenediamine and isophthalic acid), nylon 9T (a co-condensation polymer of nonanediamine and terephthalic acid), nylon M5T (a co-condensation polymer of methylpentadiamine and terephthalic acid), nylon 6T/66 (a copolymer of nylon 6T and nylon 66), nylon 6T/6I (a copolymer of nylon 6T and nylon 6I), nylon 6T/6I/66 (a copolymer of nylon 6T, nylon 6I and nylon 66), nylon 6T/M5T (a copolymer of nylon 6T and nylon M5T), and nylon 6T/6 (a copolymer of nylon 6T and nylon 6). The resin (B) may be made of one of the above-listed polyamides alone or a combination thereof. More preferably, the resin (B) is made of one or more polyamides having a melting point of 300° C. or higher, such as nylon 9T.

Moreover, nylon 6 (a condensation polymer of ∈-caprolactam), nylon 66 (a co-condensation polymer of hexamethylenediamine and adipic acid) or the like may be added to the above main polyamide (polyamides) of the resin (B). The addition of nylon 6 or nylon 66 is preferably in an amount that does not lower the melting point of the resin (B). The melting point of the resin (B) can be measured, for example, by a differential scanning calorimeter (DSC) at a heating rate of 10° C./min.

The resulting insulated wire 1 is preferably heat treated at a temperature of 250° C. or higher, after the resin composition is extrusion coated around the conductor 2 and before the resulting insulated wire 1 is wound into a coil. This heat treatment can further improve the adhesion between the wire conductor 2 and the insulation coating 3. Such an improvement in adhesion can prevent the occurrence of wrinkles in the coating 3 even when the insulated wire 1 is wound to a small diameter (e.g., the diameter of the wire 1). The adhesion improvement can also improve the wear resistance of the coating 3. There is no particular limitation on the heating time, but a heating time from several tens of seconds to several minutes is preferable. Also, there is no particular limitation on the heating method. For example, an electric furnace, a burner, a hot air heater, and an induction heater can be used. The heat treatment needs to be performed at 250° C. or higher in order to obtain an appreciable adhesion improving effect. This temperature is more than 100° C. higher than the glass transition temperature Tg of the resin composition, and around this temperature the resin composition starts to melt. Heat treatment temperatures lower than 250° C. provide no adhesion improving effect.

Another possible method for improving the adhesion between the wire conductor 2 and the insulation coating 3 is to preheat the conductor 2 to 250° C. or higher just prior to the extrusion coating in order to reduce the temperature difference between the conductor 2 and the resin composition during the extrusion coating. However, this method may have an adverse effect of degrading the adhesion because an undesirable layer such as an oxide film tends to be formed on the surface of the conductor 2.

There is no particular limitation on the thickness of the insulation coating 3, but a thickness from 80 to 180 μm is preferable. In order to improve the flexibility of the insulated wire 1 without sacrificing the partial discharge inception voltage and adhesion of the insulation coating 3, a polyolefin based resin or a resin composition prepared by modifying a polyolefin based resin with maleic anhydride or glycidyl methacrylate may be added, as an additional ingredient, to the resin composition of the invention.

The polyolefin based resin is made, for example, of an ethylene copolymer (such as polyethylene, a copolymer of ethylene and vinyl acetate, a copolymer of ethylene and ethyl acrylate, a copolymer of ethylene and methyl acrylate, and a copolymer of ethylene and glycidyl methacrylate), isotactic polypropylene, syndiotactic polypropylene, or polymethylpentene. A parts by mass ratio of the above-mentioned (modified) polyolefin based resin (C) to the polyphenylene sulfide-based resin (A), i.e. (C)/(A), is preferably from 20/80 to 70/30, and more preferably from 55/45 to 70/30. As needed, an antioxidant, a copper inhibitor, a lubricant, a coloring agent or the like may be added to the invented resin composition. Also, as needed, an additional lubricating layer may be formed around the insulation coating 3.

There is no particular limitation on the material of the wire conductor 2. Conductor materials typically used for enameled wires (e.g., oxygen-free copper and low oxygen content copper) can be used. The cross section of the wire conductor 2 is not limited to the circular one in FIG. 1, but may be rectangular.

EXAMPLES

The present invention will be described in more detail below with reference to examples. However, the invention is not limited to the specific examples described below. The contents of the resin compositions used to form the insulation coatings of Examples 1 to 11 are shown in Table 1 below. Those of Comparative Examples 1 to 3 are shown in Table 2 below.

Preparation of Examples 1 to 11 and Comparative Examples 1 to 3

The resin compositions of Examples and Comparative Examples shown in Tables 1 and 2 were extrusion coated around a 1.25-mm diameter copper wire using an extruder to form an insulated wire as shown in FIG. 1. The extrusion temperature was approximately 300° C., and the thickness of each insulation coating was approximately 150 μm. In Examples 3 to 11 and Comparative Examples 2 and 3, the resulting insulated wire was further heat treated, after the extrusion coating, in an electrical furnace at a set point temperature of 200 to 300° C.

Each of the insulated wire samples (Examples 1 to 11 and Comparative Examples 1 to 3) was subjected to the following measurement and test.

(1) Partial Discharge Inception Voltage Measurement

The partial discharge inception voltage of each insulated wire sample was measured as follows: Two 500-mm long wire pieces were cut from each insulated wire sample. The two cut wire pieces were twisted around each other under a tension of 39 N (4 kgf) in a manner to have six twists along a length of 120 mm at a middle portion of the wire piece pair. An end portion (10 mm long) of the insulation coating of both wire pieces was peeled off using a wire stripper ABISOFIX. Next, the twisted wire pair was dried in a thermostat at 120° C. for 30 min and placed in a desiccator for 18 hours until room temperature was reached. Then, the partial discharge inception voltage of the twisted wire pair was measured using a partial discharge automatic test system (DAC-6024 available from Soken Electric Co., Ltd.) The measurement was conducted at 25° C. and 50% relative humidity. A 50-Hz voltage was applied to the twisted wire pair to charge it, and the voltage was increased at a rate of 10 to 30 V/s. The partial discharge inception voltage Vp of the twisted wire pair was defined as the voltage at which a discharge of 50 pC began to occur 50 times or more.

(2) Adhesion Test

Each insulated wire sample was subjected to a sudden tensile test described in JIS C 3003. The adhesion of the insulated wire sample was evaluated by the peel length. The peel length was defined as the length (as measured from the region of fracture) of the insulation coating that had been peeled or lifted off from the wire conductor by the sudden tensile test. In Tables 1 and 2, a sample having a peel length of 2 mm or shorter is marked with "E" meaning that the sample passed the adhesion test excellently; a sample having a peel length of between 2 mm and 20 mm is marked with "P" meaning that the sample passed the adhesion test; and a sample having a peel length of 20 mm or longer is marked with "F" meaning that the sample failed the adhesion test.

(3) Thermal Resistance Test

The thermal resistance of each insulated wire sample was tested as follows: Two 500-mm long wire pieces were cut from each insulated wire sample. The two cut wire pieces were twisted around each other under a tension of 39 N (4 kgf) in a manner to have six twists along a length of 120 mm at a middle portion of the wire piece pair. Next, the twisted wire pair was aged in an aging tester (a gear oven STD60P available from Toyo Seiki Kogyo Co., Ltd.) at 150° C. for 20-00 hours. Then, the aged twisted wire pair was wound around a 4-mm diameter round rod, and was observed under a 50× optical microscope for the presence or absence of surface defects such as cracks. In Tables 1 and 2, a sample without any surface defects (such as cracks, crazings and wrinkles) is marked with "E" meaning that the sample passed the thermal resistance test excellently; a sample without any cracks is marked with "P" meaning that the sample passed the thermal resistance test; and a sample having cracks is marked with "F" meaning that the sample failed the thermal resistance test.

The contents of the resin compositions and the measurement and test results of the insulated wires for Examples 1 to 11 are shown in Table 1. Those for Comparative Examples 1 to 3 are shown in Table 2.

TABLE 1

Resin Composition and Test Result of Examples 1 to 11.

| | | Example | | | | | |
|---|---|---|---|---|---|---|---|
| | Resin Composition | 1 | 2 | 3 | 4 | 5 | 6 |
| Contents (Parts by Mass) | Polyphenylene Sulfide | 95 | 90 | 90 | 90 | 90 | 90 |
| | Nylon 46 (Melting Point: 290° C.) | 5 | 10 | — | — | — | — |

TABLE 1-continued

| Resin Composition and Test Result of Examples 1 to 11. | | | | | | | |
|---|---|---|---|---|---|---|---|
| | Nylon 6T/6I (Melting Point: 320° C.) | — | — | 10 | 10 | — | — |
| | Nylon 9T (Melting Point: 308° C.) | — | — | — | — | 10 | 10 |
| | Nylon 6T/66 (Melting Point: 290° C.) | — | — | — | — | — | — |
| | Nylon 6T/M5T (Melting Point: 300° C.) | — | — | — | — | — | — |
| | Nylon 66 (Melting Point: 260° C.) | — | — | — | — | — | — |
| Insulation Coating Thickness (μm) | | 150 | | | | | |
| Heat Treatment Temperature (° C.) | | None | | 200 | 250 | 280 | 300 |
| Test Result | Partial Discharge Inception Voltage (Vp) | 1950 | 1900 | 2000 | 2100 | 2000 | 2100 |
| | Adhesion | P | P | P | E | E | E |
| | Thermal Resistance | E | E | E | E | E | E |

| | | Example | | | | |
|---|---|---|---|---|---|---|
| | Resin Composition | 7 | 8 | 9 | 10 | 11 |
| Contents (Parts by Mass) | Polyphenylene Sulfide | 70 | 90 | 80 | 90 | 90 |
| | Nylon 46 (Melting Point: 290° C.) | — | — | 10 | — | — |
| | Nylon 6T/6I (Melting Point: 320° C.) | — | — | — | — | — |
| | Nylon 9T (Melting Point: 308° C.) | 30 | — | 10 | — | — |
| | Nylon 6T/66 (Melting Point: 290° C.) | — | 10 | — | — | — |
| | Nylon 6T/M5T (Melting Point: 300° C.) | — | — | — | 10 | — |
| | Nylon 66 (Melting Point: 260° C.) | 5 | 5 | — | — | 10 |
| Insulation Coating Thickness (μm) | | 150 | | | | |
| Heat Treatment Temperature (° C.) | | 300 | 300 | 300 | 300 | 300 |
| Test Result | Partial Discharge Inception Voltage (Vp) | 1850 | 1900 | 1850 | 1800 | 1800 |
| | Adhesion | E | E | E | E | E |
| | Thermal Resistance | E | E | E | E | P |

TABLE 2

| Resin Composition and Test Result of Comparative Examples 1 to 3. | | | | |
|---|---|---|---|---|
| | | Comparative Example | | |
| | Resin Composition | 1 | 2 | 3 |
| Contents (Parts by Mass) | Polyphenylene Sulfide | 100 | 100 | 60 |
| | Nylon 46 (Melting Point: 290° C.) | — | — | — |
| | Nylon 6T/6I (Melting Point: 320° C.) | — | — | — |
| | Nylon 9T (Melting Point: 308° C.) | — | — | 40 |
| | Nylon 6T/66 (Melting Point: 290° C.) | — | — | — |
| | Nylon 6T/M5T (Melting Point: 300° C.) | — | — | — |
| | Nylon 66 (Melting Point: 260° C.) | — | — | — |
| Insulation Coating Thickness (μm) | | 150 | | |
| Heat Treatment Temperature (° C.) | | None | 300 | 300 |
| Test Result | Partial Discharge Inception Voltage (Vp) | 1700 | 1750 | 1450 |
| | Adhesion | F | F | P |
| | Thermal Resistance | F | F | P |

As shown in Table 1, the insulation coatings of the invented insulated wires of Examples 1 to 11 have a thickness of about 150 μm, which is comparable to those of conventional insulation coatings; nevertheless the invented insulated wires have a partial discharge inception voltage Vp as high as more than 1800 V. Also, the invented insulated wires of Examples 1 to 11 have a sufficiently good adhesion and thermal resistance. Examples 4 to 11, in which the insulated wire was further heat treated (as a post heat treatment) at 250° C. or higher after the extrusion coating, exhibit an improved adhesion compared to Examples 1 and 2 (which were not subjected to the post heat treatment) and Example 3 (in which the post heat treatment was performed below 250° C.). Examples 1 to 10, in which the resin (B) was made of one or more polyamides having a melting point of 280° C. or higher, exhibit a better thermal resistance than Example 11 (in which the resin (B) was made of a polyamide having a melting point of lower than 280° C.).

In contrast, as shown in Table 2, Comparative Examples 1 and 2, in which the resin composition contains only a polyphenylene sulfide-based resin, exhibit a poor adhesion and, as a result, a poor thermal resistance. Also, Comparative Examples 1 and 2 exhibit a low partial discharge inception voltage compared to the invented insulated wires of Examples 1 to 11. In addition, Comparative Example 3, in which the parts by mass ratio of the polyamide-based resin (B) to the polyphenylene sulfide-based resin (A), i.e. (B)/(A), was out of the range specified by the invention, exhibit an appreciably lower partial discharge inception voltage than the invented insulated wires.

The above results demonstrate that the invented insulated wires of Examples 1 to 11 have a higher partial discharge inception voltage than conventional insulated wires without sacrificing the adhesion between the wire conductor and the insulation coating (i.e., while maintaining the adhesion to levels comparable to those of conventional insulation coatings). Also, insulated wires according to the invention have a simple structure in that the insulation coating is formed from a single layer. Thus, cost reduction can be obtained.

Although the invention has been described with respect to the specific embodiments for complete and clear disclosure, the appended claims are not to be thus limited but are to be construed as embodying all modifications and alternative constructions that may occur to one skilled in the art which fairly fall within the basic teaching herein set forth.

What is claimed is:

1. An insulated wire comprising:

a wire conductor; and an insulation coating formed on the wire conductor by extrusion coating a resin composition, the insulated wire being heat treated at 250° C. or higher after the extrusion coating of the insulation coating, the resin composition being a mixture of a polyphenylene sulfide-based resin (A) and a polyamide-based resin (B), a ratio of parts by mass of the resin (B) to that of the resin (A) being not less than 5/95 and not more than 30/70, wherein the resin (B) includes at least nylon 46, wherein the insulated wire exhibits a partial discharge inception voltage of 1800 V or more when a thickness of the insulation coating is 150 μm, and wherein an adhesion property between the insulation coating and the wire conductor is such that a peel length is 2 mm or shorter under a sudden tensile test described in JIS C 3003.

2. The insulated wire according to claim 1, wherein the resin (B) further includes at least one more polyamide-based resin having a melting point of 280° C. or higher.

3. The insulated wire according to claim 1, wherein the resin (B) further includes at least one resin selected from the group consisting of nylon 6T, nylon 6I, nylon 9T, and nylon M5T.

4. The insulated wire according to claim 1, wherein the resin composition consists of the polyphenylene sulfide-based resin (A) and at least one polyamide-based resin (B).

5. The insulated wire according to claim 1, wherein the resin composition consists essentially of the polyphenylene sulfide-based resin (A) and at least one polyamide-based resin (B).

6. An insulated wire comprising:

a wire conductor; and an insulation coating formed directly on the wire conductor by extrusion coating a resin composition, the insulated wire being heat treated at 250° C. or higher after the extrusion coating of the insulation coating, the resin composition comprising a mixture of a polyphenylene sulfide-based resin (A) and a polyamide-based resin (B), a ratio of parts by mass of the resin (B) to that of the resin (A) being not less than 5/95 and not more than 30/70, wherein the resin (B) includes at least nylon 46, wherein the insulated wire exhibits a partial discharge inception voltage of 1800 V or more when a thickness of the insulation coating is 150 μm, and wherein an adhesion property between the insulation coating and the wire conductor is such that a peel length is 2 mm or shorter under a sudden tensile test described in JIS C 3003.

7. The insulated wire according to claim 6, wherein the resin (B) further includes at least one more polyimide-based resin having a melting point of 280° C. or higher.

8. The insulated wire according to claim 6, wherein the resin (B) further includes at least one resin selected from the group consisting of, nylon 6T, nylon 6I, nylon 9T, and nylon M5T.

9. The insulated wire according to claim 6, wherein the resin composition consists of the polyphenylene sulfide-based resin (A) and at least one polyimide-based resin (B).

10. The insulated wire according to claim 6, wherein the resin composition consists essentially of the polyphenylene sulfide-based resin (A) and at least one polyamide-based resin (B).

* * * * *